US006382427B1

(12) United States Patent
Nakhei-Nejad

(10) Patent No.: US 6,382,427 B1
(45) Date of Patent: May 7, 2002

(54) PISTACHIO SEPARATOR

(76) Inventor: Mohammad Nakhei-Nejad, #402, 10721 Saskatchewan Drive, Edmonton AB (CA), T6E 6J5

( * ) Notice: Subject to any disclaimer, the term of this patent is extended or adjusted under 35 U.S.C. 154(b) by 0 days.

(21) Appl. No.: 09/826,895

(22) Filed: Apr. 6, 2001

(51) Int. Cl.[7] ..... B07C 5/00; B07B 13/11

(52) U.S. Cl. ..... 209/700; 209/45; 209/46; 99/569

(58) Field of Search ..... 209/700, 45, 46, 209/940; 99/569

(56) References Cited

U.S. PATENT DOCUMENTS

| | | | | |
|---|---|---|---|---|
| 822,105 A | | 5/1906 | Eklund | |
| 867,276 A | * | 10/1907 | Jenkins | 209/540 |
| 1,318,003 A | * | 10/1919 | Wheeler et al. | 209/45 |
| 2,428,852 A | * | 1/1947 | Muir et al. | 198/525 |
| 4,034,665 A | | 7/1977 | McFarland et al. | |
| 4,353,931 A | | 10/1982 | Volk, Sr. | |
| 4,448,115 A | | 5/1984 | Volk, Sr. | |
| RE31,979 E | | 9/1985 | Volk, Sr. | |
| 4,874,097 A | | 10/1989 | Arairiadis | |
| 5,245,918 A | | 9/1993 | Volk, Sr. | |
| 5,329,845 A | | 7/1994 | Bichel | |
| 5,720,395 A | * | 2/1998 | Schock et al. | 209/700 |
| 5,879,734 A | | 3/1999 | Broyles | |

FOREIGN PATENT DOCUMENTS

| | | | |
|---|---|---|---|
| EP | 00050925 A2 | * | 10/1992 |
| WO | WO-8902320 | * | 3/1989 |

* cited by examiner

*Primary Examiner*—Donald P. Walsh
*Assistant Examiner*—Joseph C Rodriguez
(74) *Attorney, Agent, or Firm*—Bennett Jones LLP

(57) ABSTRACT

An apparatus for separating hulled and unhulled pistachios includes a rotating drum and a conveyor for depositing pistachios onto the drum. Rotation of the drum frictionally separates hulled and unhulled pistachios.

8 Claims, 3 Drawing Sheets

PISTACHIO SEPARATOR

FIELD OF THE INVENTION

The present invention relates to an apparatus for separating hulled pistachio nuts from unhulled pistachio nuts.

BACKGROUND OF THE INVENTION

Pistachio nuts have a hard shell around the edible nut and a pericarp or hull which encases the shell. The hull of unripened pistachios adheres strongly to the shell and is difficult to remove whereas the hull is relatively easily removed from ripe pistachios. It is necessary to mechanically hull pistachios in order to process commercial quantities of the nut.

The hulling of pistachios presents unusual problems of difficult solution. The hulls of pistachios are stronger, more tenaciously adherent to the shells, and more difficult to remove than the hulls of many nuts, particularly if the pistachio is not yet ripe. If the hull is not promptly removed from pistachios after harvest, it discolors the shells requiring that the normally attractive straw colored shells be colored to hide undesirable stains. For this reason, most commercial pistachios are dyed an unnatural and undesirable pink or red color to obscure the stains. Even when abundant hand labor is available, it is usually not feasible to hull sufficiently large volumes of pistachios soon enough after harvest to avoid shell discoloration. As a result, mechanical dehullers of various configurations have been developed. However, the dehulling apparatuses are designed to dehull only those pistachios which are easily dehulled, otherwise, the machines could damage the pistachios. Many pistachios are left with the hull intact or still clinging to the shell, particularly unripe pistachios. It is a laborious job to sort hulled pistachios from unhulled pistachios manually.

Therefore, there is a need in the art for an automated process and system for separating hulled pistachios from unhulled pistachios.

SUMMARY OF THE INVENTION

In general term, the invention provides a method and apparatus for separating unhulled pistachios from hulled pistachios. The pistachios are deposited onto the outside surface of the upper half of a rotating drum, on a portion of the drum where the outer surface is ascending. Pistachios which contact the drum are pulled upward by the rotation of the drum and pulled downward by the force of gravity. If the upward force overcomes the force of gravity, the pistachio will be pulled over the top of the drum and deposited on the other side.

A pistachio hull is more adhesive than a pistachio shell, which is relatively harder and smoother, particularly when the hull is damp. Therefore, if the drum rotates at a sufficient rate, unhulled pistachios and pistachios with the hull or a portion of the hull still attached will tend to be pulled upward by the rotation of the drum while hulled pistachios will tend to slide down the drum surface and not be pulled up and over the drum to the descending half side of the drum.

One skilled in the art will realize that the apparatuses and methods disclosed herein may be adapted to separate other nuts, berries or beans, where ripe and unripe (or desired and undesired) nuts, berries or beans have different coefficients of friction with the rotating surface of the drum. Further, the apparatuses and methods of the present invention may be used to separate such items from impurities such as branches, twigs, leaves if such frictional differences exist.

In one aspect of the invention, the invention comprises an apparatus for separating unhulled pistachios and hulled pistachios comprising:

(a) a support frame;

(b) a substantially cylindrical, horizontal drum rotatably mounted to the frame and having an ascending portion and a descending portion;

(c) means for rotating the drum; and (d) means for depositing a mixture of hulled and unhulled pistachios onto the ascending portion of the drum.

In one embodiment, the pistachio depositing means comprises a conveyor supported by the frame and having a first end and a second end, wherein said second end is adjacent to the ascending portion of the drum, wherein pistachios are deposited on the first end, transported to the second end and deposited onto the rotating drum therefrom.

In another aspect, the invention may comprise an apparatus for separating unhulled pistachios from hulled pistachios comprising:

(a) a rotating drum having an outer surface which frictionally engages unhulled pistachios preferentially to hulled pistachios; and (b) means for depositing pistachios onto the outer surface of the rotating drum on an upper portion of the drum where the outer surface is ascending.

In another aspect, the invention may comprise a method of separating unhulled pistachios from hulled pistachios comprising the steps of:

(a) providing a rotating drum having an outer surface which frictionally engages unhulled pistachios preferentially to hulled pistachios; and (b) depositing pistachios onto the outer surface of the rotating drum on an upper portion of the drum where the outer surface is ascending;

(c) collecting unhulled pistachios from the descending half side of the drum; and (d) collecting hulled pistachios from the ascending half side of the drum.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for an apparatus which separates hulled pistachios from unhulled pistachios and pistachios with the hull still attached. When describing the present invention all terms not defined herein have their common art-recognized meanings.

The apparatus (10) shown in the Figures comprises primarily of a rotating drum (12) and a conveyor (14) which feeds pistachios onto the drum. The conveyor (14) acts as means for depositing the pistachios onto the drum (12). Alternatively, the pistachios may be deposited onto the drum surface directly from a hopper (not shown) which has an opening above the drum surface.

As used herein, "ascending half" refers to the lateral half of the rotating drum, as seen in vertical cross-section, where the outer circumference of the drum moves upwardly. Similarly, "descending half" refers to the other lateral half of the rotating drum where the outer circumference of the drum moves downwardly.

Figure 1:
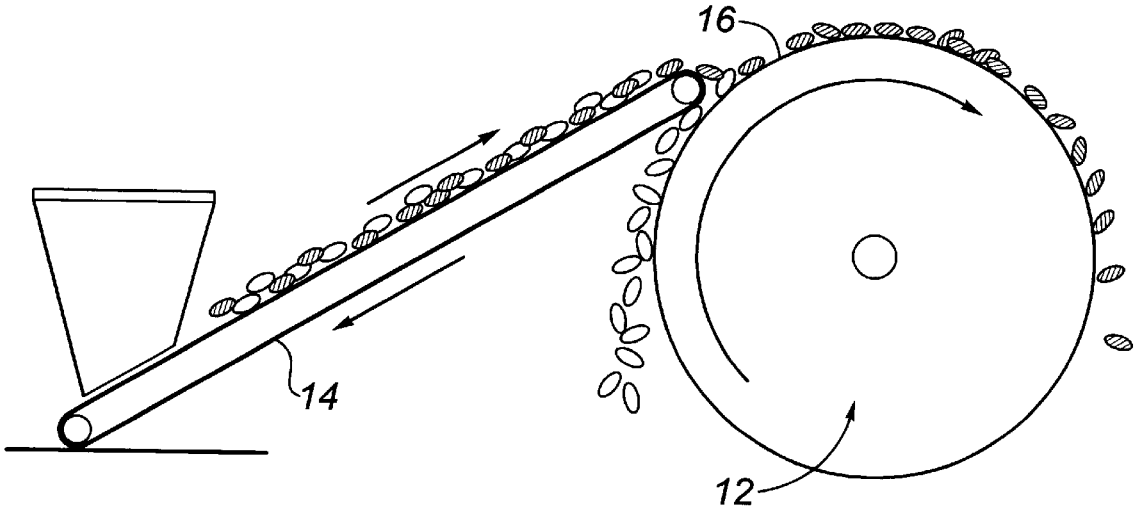
FIG. 1 is a schematic representation of one embodiment of the invention.

As shown in FIG. 1, the pistachios are deposited onto the upper half of the drum (12), on a portion of the drum where the outer surface (16) is ascending. Pistachios which contact the drum (12) are pulled upward by the rotation of the drum and pulled downward by the force of gravity. If the upward force overcomes the force of gravity, the pistachio will be pulled over the top of the drum and deposited on the other side (the descending half side).

A pistachio hull is "stickier" than a pistachio shell, which is relatively harder and smoother, particularly if the hull is damp. Therefore, if the drum rotates at a sufficient rate, unhulled pistachios and pistachios with the hull or a portion of the hull still attached will tend to be pulled upward by the rotation of the drum while hulled pistachios will tend to slide down the drum surface and not be pulled up and over the drum to the descending half side of the drum.

As is apparent, the closer to the top of the drum the pistachios are deposited, the more likely the pistachio is to be transported by the drum to the other side of the drum. Conversely, the closer to the side of the drum where the outer surface tangent is vertical, the more likely it is that the pistachio will simply drop off the drum without being transported over the drum. Therefore, it is preferred that the position of the conveyor be adjustable in order to allow adjustment of the initial contact point of the pistachios on the drum. This adjustment permits the apparatus (10) to be biased towards ensuring that no unhulled pistachios are mixed with the hulled pistachios, at the expense of removing a large number of hulled pistachios, or towards minimizing removal of hulled pistachios, increasing the possibility of unhulled pistachios being mixed with the hulled pistachios.

Figure 2:
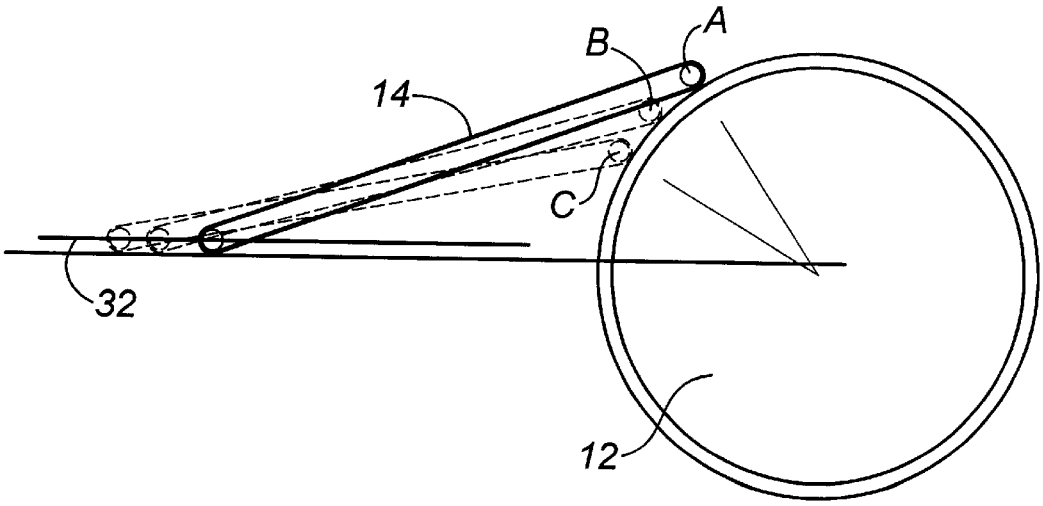
FIG. 2 is a schematic representation of one embodiment, showing adjustability of the conveyor means.

In one embodiment, as is schematically illustrated in FIG. 2, the desired adjustability is provided by mounting one end of the conveyor to a horizontal track which permits movement of the conveyor horizontally. If the lower end of the conveyor is moved closer to the drum and the conveyor is tilted further upwards (position A), then the pistachios will be deposited on a portion of the drum with a greater horizontal component. In such a case, there will be a greater tendency for pistachios to be pulled over the top of the drum. Conversely, if the lower end of the conveyor is moved farther away from the drum and the inclination of the conveyor reduced (position C), the pistachios will be deposited on a portion of the drum with a greater vertical component. In such a case, there will be a greater tendency for pistachios to simply drop off the drum and not be carried over the top of the drum. An intermediate position B is also illustrated in FIG. 2.

As well, it will be apparent to one skilled in the art that the speed of rotation of the drum may also affect the degree of separation effected by the apparatus. Therefore, in one embodiment, the speed of the drum rotation may be adjustable.

In one embodiment, the conveyor (14) speed is set, or the rate pistachios are delivered to the conveyor is set, to ensure that only a single layer of pistachios is deposited onto the drum from the conveyor. If an excess number of pistachios are deposited onto the drum by the conveyor, not all pistachios may contact the drum and the separating ability of the present invention may be compromised. Further, it is preferred that the upper end of the conveyor be spaced relatively close to the drum surface (16) in order to minimize "bounce" of pistachios off the drum surface. In a preferred embodiment, the gap between the conveyor and the drum is only slightly larger than the size of the pistachios themselves. This gap permits the pistachios to fall between the conveyor and the drum while minimizing the size of the gap. Preferably, a guide is provided to maintain this gap throughout the adjustable range of motion of the conveyor if the conveyor is adjustable.

Figure 3:
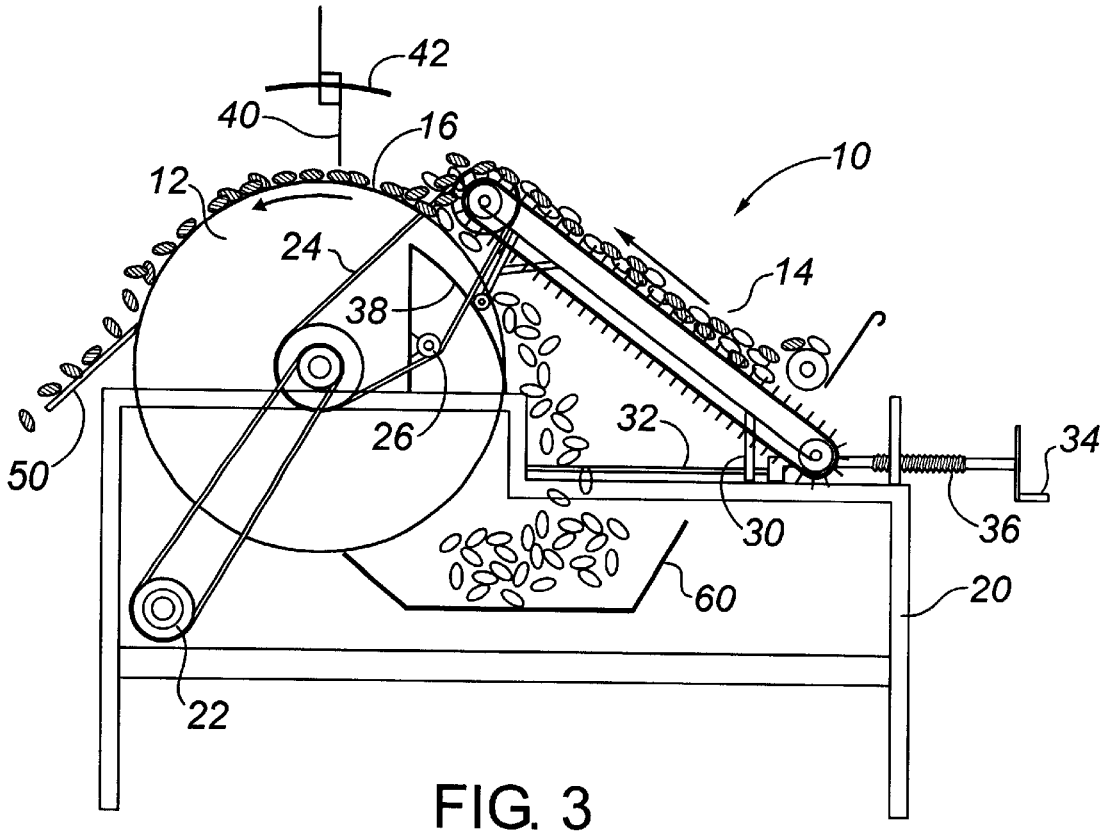
FIG. 3 is a cross-sectional view of one embodiment.
Figure 4:
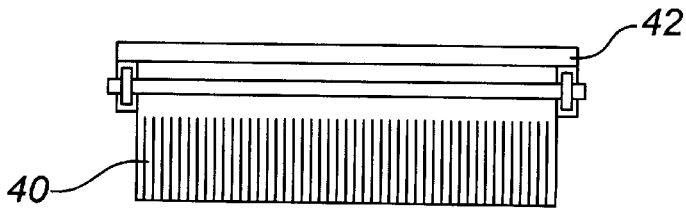
FIG. 4 is a view of the optional curtain attachment of one embodiment.
Figure 5:
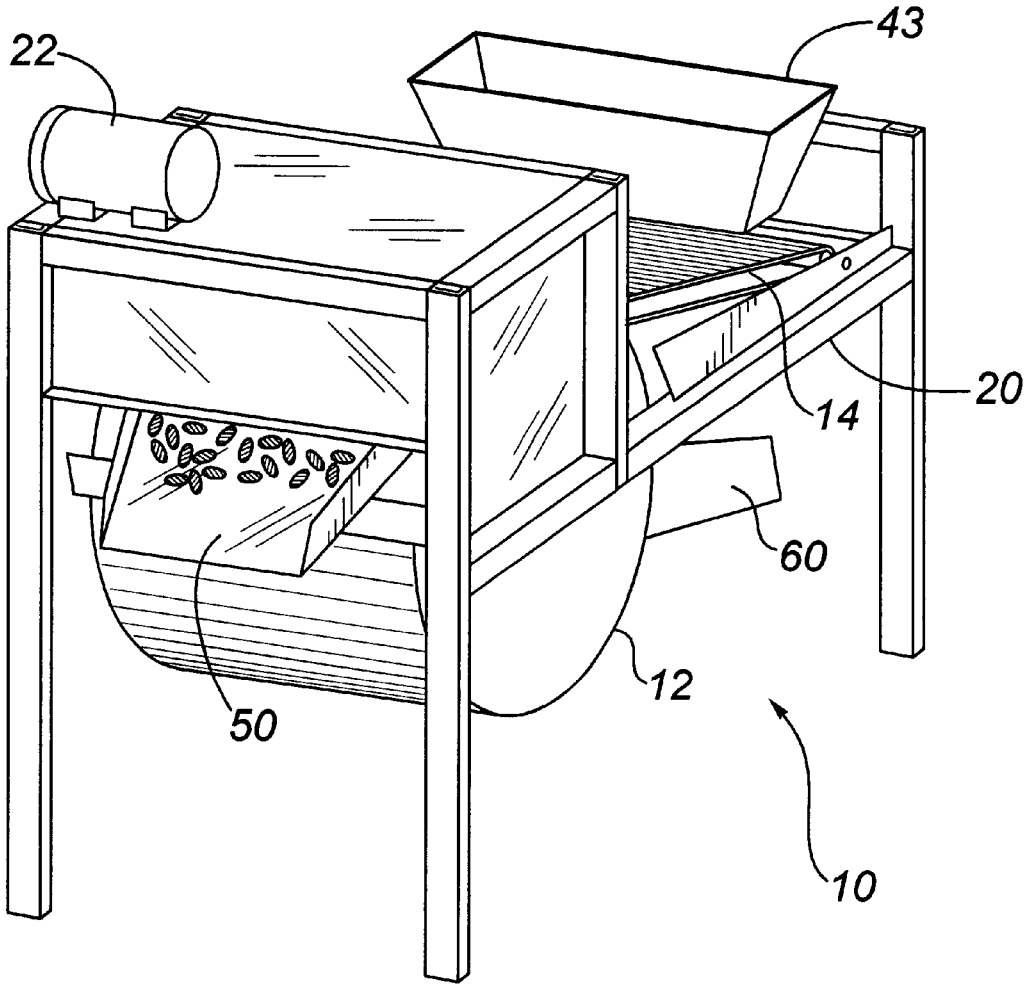
FIG. 5 is a perspective view of one embodiment.

FIG. 3 illustrates an embodiment is shown which has the drum (12) and conveyor (14) mounted to a frame (20). The drum (12) is belt or chain-driven by an electric motor (22), which may also drive the conveyor (14) by a belt or chain (24) in the embodiment illustrated. A chain tensioner (26) may be provided. The nature of the drum and conveyor actuation is not an essential element of the invention. The lower end of the conveyor is supported by a strut (30) which slides horizontally along a track (32). In the embodiment shown, the position of the lower end of the conveyor (14) may be positioned by a handcrank (34) which turns a screwrod (36). The upper end of the conveyor rests upon and slides along a guiderail (38) which is inclined and curved upwards. The guiderail (38) increases the inclination of the conveyor as it is moved closer to the drum and decreases the inclination as the conveyor is moved away from the drum. In this manner, the gap between the drum and the conveyor is maintained as the conveyor position is adjusted relative to the drum.

The drum (12) may comprise any material and in one embodiment, is formed from steel. The outer surface of the drum should preferably comprise a material which has a relatively smooth, non-stick surface. Hulled pistachios should slide easily off the drum surface while damp unhulled pistachios should adhere slightly to the drum surface.

The conveyor (14) may be any continuous rotating belt or trays or the like. The function of the conveyor is simply to deliver pistachios to the drum surface to allow for separation by rotation of the drum. A hopper (42) is provided to deliver the pistachios to the lower end of the conveyor (14). As stated above, the conveyor may not be necessary if a hopper outlet (not shown) is placed directly adjacent the drum and the pistachios are deposited onto the drum from the hopper directly. The outlet of the hopper should preferably be elongate and narrow to control the rate pistachios are deposited onto the drum.

In one embodiment, a curtain (40) is hung above the drum (12) and assists to separate hulled pistachios from unhulled pistachios. In one embodiment, the curtain (40) comprises a plurality of flexible rubber strips which are positioned above the drum such that the ends of the rubber strips are separated from the drum by a gap which is slightly less than the size of a pistachio nut. The curtain's function is to physically impede the passage of pistachios underneath the curtain so that hulled pistachios are knocked off the drum and do not pass under the curtain while unhulled pistachios, because of their adherence to the drum, pass under the curtain. The curtain may comprise filaments or strips of any suitable flexible material such as fabrics, rubber, elastomers, plastics or metals. In a preferred embodiment, the lateral position of the curtain may be adjusted along an arcuate guide (42) such that the gap between the bottom of the curtain and the drum remains constant.

Pistachios which pass over the drum (12) are removed by deflector (50) which directs the pistachios to a collection bin for disposal or further processing. These pistachios should be primarily unhulled pistachios.

Pistachios which do not pass over the drum fall beneath the conveyor into a collection tray (60). In one embodiment, the collection tray may be vibrated to move the pistachios off the apparatus.

As will be apparent to those skilled in the art, various modifications, adaptations and variations of the foregoing specific disclosure can be made without departing from the scope of the invention claimed herein.

What is claimed is:

1. An apparatus for separating unhulled pistachios and hulled pistachios comprising:

(a) a support frame;

(b) a substantially cylindrical, horizontal drum rotatably mounted to the frame and having an ascending portion and a descending portion and an outer surface which frictionally engages unhulled pistachios preferentially to hulled pistachios;

(c) means for rotating the drum;

(d) a conveyor supported by the frame and having a first end and a second end, wherein said second end is adjacent to the ascending portion of the drum, wherein pistachios are deposited on the first end, transported to the second end and deposited onto the rotating drum therefrom, wherein the first end of the conveyor is mounted to a track on the frame permitting lateral movement of the first end of the conveyor;

(e) means for moving the lateral position of the first end of the conveyor; and (f) means for collecting unhulled pistachios from the descending portion.

2. The apparatus of claim 1 wherein the second end rests on a curved guide such that a gap between the drum and the second end remains substantially constant throughout the range of motion of the conveyor.

3. The apparatus of claim 1 further comprising a flexible curtain hanging above an upper portion of the drum, wherein said curtain is positioned to contact pistachios on the surface of the drum.

4. The apparatus of claim 3 wherein said curtain comprises a plurality of hanging sheets or filaments.

5. The apparatus of claim 1 further comprising means for collecting hulled pistachios from the ascending portion of the drum.

6. A method of separating unhulled pistachios from hulled pistachios comprising the steps of:

(a) providing a rotating drum having an outer surface which frictionally engages unhulled pistachios preferentially to hulled pistachios; and (b) depositing pistachios onto the outer surface of the rotating drum on an upper portion of the drum where the outer surface is ascending;

(c) collecting unhulled pistachios from the descending half side of the drum; and (d) collecting hulled pistachios from the ascending half side of the drum.

7. The method of claim 6 wherein the pistachios are deposited on the drum by means of a continuous conveyor.

8. The method of claim 7 wherein the height and/or inclination of the conveyor is adjustable.

* * * * *